United States Patent [19]

Ortloff

[11] Patent Number: 4,677,930

[45] Date of Patent: Jul. 7, 1987

[54] APPARATUS FOR QUICK-RELEASE OF A STORAGE VESSEL FROM A RISER

[75] Inventor: John E. Ortloff, Houston, Tex.

[73] Assignee: Exxon Production Research Co., Houston, Tex.

[21] Appl. No.: 937,450

[22] Filed: Dec. 5, 1986

Related U.S. Application Data

[63] Continuation of Ser. No. 760,783, Jul. 31, 1985, abandoned.

[51] Int. Cl.[4] ..... B63B 21/00

[52] U.S. Cl. ..... 114/230; 114/249; 441/3; 292/201

[58] Field of Search ..... 114/230, 249, 250, 252; 441/3-5; 405/195, 199; 292/201, 207; 280/504, 415 R, 461 A, 460 A, 456 A

[56] References Cited

U.S. PATENT DOCUMENTS

| | | | |
|---|---|---|---|
| 1,824,843 | 9/1931 | Staley | 280/504 |
| 3,133,521 | 5/1964 | Cappel | 114/230 |
| 3,640,238 | 2/1972 | Stockdale | 114/249 |
| 3,826,517 | 7/1974 | Hunter | 280/504 X |
| 3,910,219 | 10/1975 | Ono et al. | 114/235 |
| 4,079,690 | 3/1978 | Paul | 114/230 |
| 4,119,051 | 10/1978 | Orndorff, Jr. | 114/249 |
| 4,158,996 | 6/1979 | Marulic et al. | 292/207 X |
| 4,193,368 | 3/1980 | DeGraaf et al. | 114/230 |
| 4,459,930 | 11/1984 | Flory | 114/230 |

FOREIGN PATENT DOCUMENTS

| | | | |
|---|---|---|---|
| 1902416 | 8/1970 | Fed. Rep. of Germany | 114/249 |
| 1295710 | 11/1972 | United Kingdom | 292/201 |
| 1085893 | 4/1984 | U.S.S.R. | 114/249 |

*Primary Examiner*—Joseph F. Peters, Jr.
*Assistant Examiner*—Paul E. Salmon
*Attorney, Agent, or Firm*—Marc L. Delflache

[57] ABSTRACT

An apparatus is described for securing two offshore mooring sections together. The apparatus is a connector adapted to quickly disengage each mooring section so that an offshore floating storage vessel, having one mooring section attached to it, may be separated from the riser of an single-anchor-leg-mooring system, having the other mooring section attached to it. The connector comprises a pin member engageable with a hook of a latch member. The latch member is rotated once the hook engages the pin member and a plunger then advances into an open region of the hook prohibiting the rotational movement of the latch member and thereby locking the two mooring sections together.

14 Claims, 6 Drawing Figures

APPARATUS FOR QUICK-RELEASE OF A STORAGE VESSEL FROM A RISER

CROSS REFERENCE TO RELATED APPLICATIONS

This application is a continuation of application Ser. No. 760,783, filed July 31, 1985, now abandoned.

FIELD OF THE INVENTION

The present invention relates to an apparatus for the release of a storage vessel from a riser. More particularly, the present invention relates to a connector for the quick-release of a floating storage vessel from the riser of a single-anchor-leg-mooring system.

BACKGROUND OF THE INVENTION

In the offshore production of oil and natural gas, floating vessels are frequently used to temporarily store the hydrocarbons prior to shipment to onshore production and refining facilities. The hydrocarbons are produced from an offshore structure which is usually anchored to the seafloor with piling or from a subsea production system (SPS). In both cases, the hydrocarbons are shipped, usually via a pipeline, to an offshore floating terminal which is occasionally referred to as a single-anchor-leg-mooring (SALM) system. A typical SALM is comprised of a base structure which is positioned on the marine bottom and a riser which is connected to the base structure and extends above the water surface. At the upper end of the riser is attached an articulated mooring arm which in turn is connected to a floating storage vessel. Usually, the floating vessel is a converted tanker and is permanently moored to the riser via the articulated mooring arm. The pipeline, which carries the hydrocarbons from the offshore structure or SPS, continues up along the riser and across the articulated mooring arm into the storage compartments of the floating vessel. Shuttle tankers then offload the hydrocarbons from the floating vessel for transportation to onshore facilities.

In an offshore environment the articulated mooring arm must be sufficiently flexible to accommodate the movement of the vessel relative to the riser. As the vessel is acted upon by forces induced by winds, waves, ice masses, ocean currents, etc., the vessel will roll, pitch and heave. In addition, the vessel will yaw about its mooring point as the direction of the forces vary.

During an emergency condition such as the arrival of a hurricane or ice masses, it may be necessary to effect a quick disconnection of the vessel from the riser. The emergency situation is aggravated by the fact that the disconnection must occur quickly enough to prevent damage to the vessel, articulated mooring arm, and riser. Once disconnected, the movement of the vessel forward into the articulated mooring arm as a result of sea movement can cause significant damage to the vessel, articulated mooring arm, and riser.

Accordingly, the need exists for an improved apparatus which effects the quick and accurately-timed disconnection of a floating storage vessel from the riser of an SALM in a manner which permits an operator time to safely reverse the vessel away from the riser before any contact is made.

SUMMARY OF THE INVENTION

Generally, the present invention is a quick-release connector for securing two offshore mooring sections of an articulated mooring arm which connect an offshore floating storage vessel to the riser of an SALM.

More precisely, the connector comprises a pin member in direct engagement with a latch member having a hook adapted for rotational movement about the pin member. The connector also includes a plunger which is capable of advancing from one position wherein the latch member is locked around the pin member and rotational movement is prohibited to another position wherein the plunger is displaced from the hook and the latch member is permitted to rotate around the pin member. The connector also includes means for displacing the plunger between the two positions and means for rotating the latch member about the pin member so that the vessel may quickly reversed and displaced from the riser before contact occurs.

The more important features of the present invention have been summarized rather broadly in order that the detailed description which follows may be better understood. There are, of course, additional features of the present invention which will be described hereinafter and which will also form the subject of the claims appended hereto.

DETAILED DESCRIPTION OF THE DRAWINGS

In order to more fully understand the drawings used in the detailed description of the present invention, a brief description of each figure is provided.

DETAILED DESCRIPTION OF THE INVENTION

Figure 1:
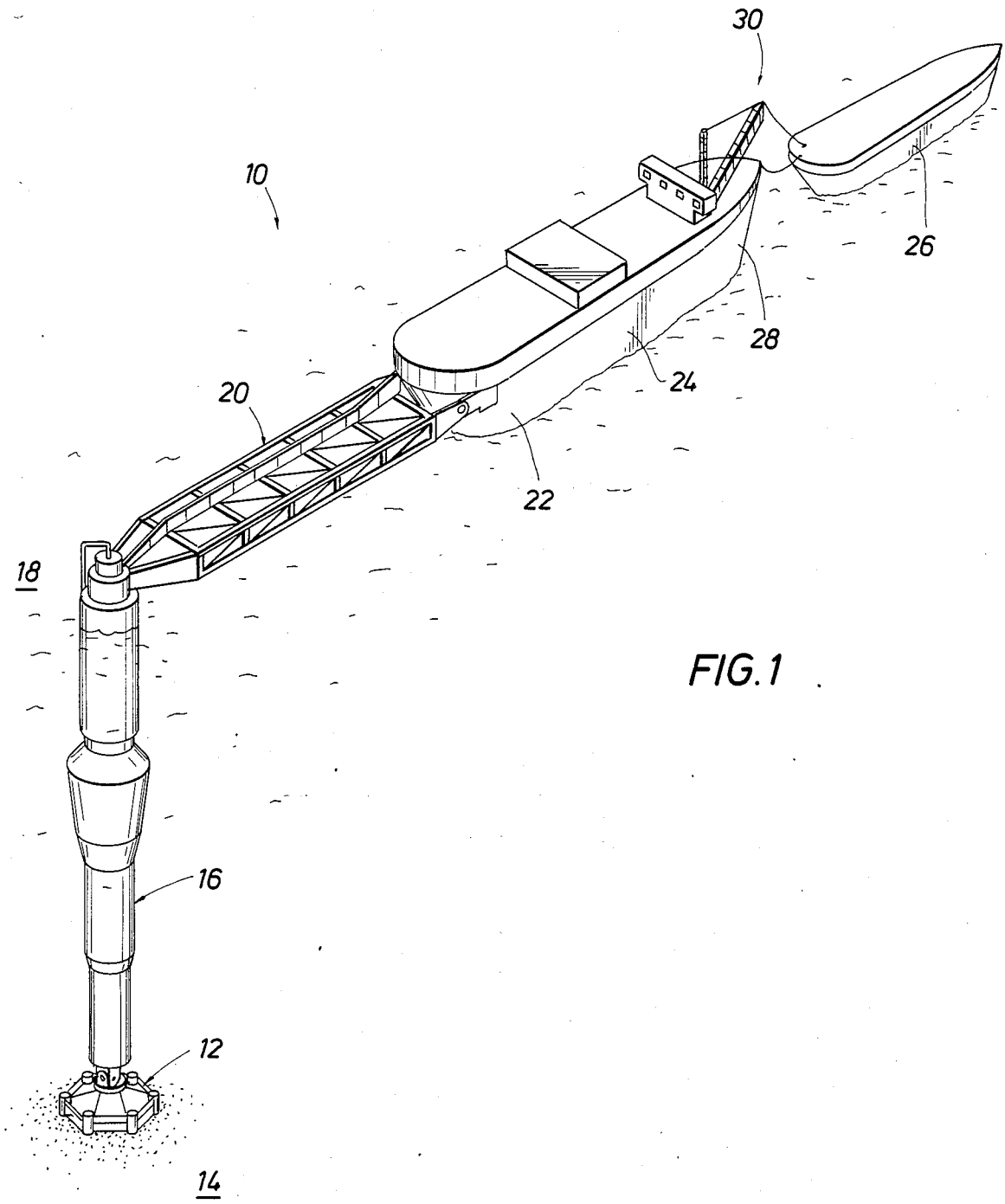
FIG. 1 is an isometric view of an SALM attached to an offshore floating storage vessel by means of an articulated mooring arm.

Referring now to FIG. 1, an SALM 10 is shown having a base structure 12 positioned on the marine bottom 14 and a riser 16 connected to the base structure and extending above the water surface 18. An articulated mooring arm 20 is attached at one end to the top of the riser and at its other end to the bow 22 of an offshore floating storage vessel 24. A shuttle tanker 26 is temporarily moored to the stern 28 of the vessel 24 and is unloading hydrocarbons from the vessel 24 by means of an offshore loading system 30.

Figure 2A:
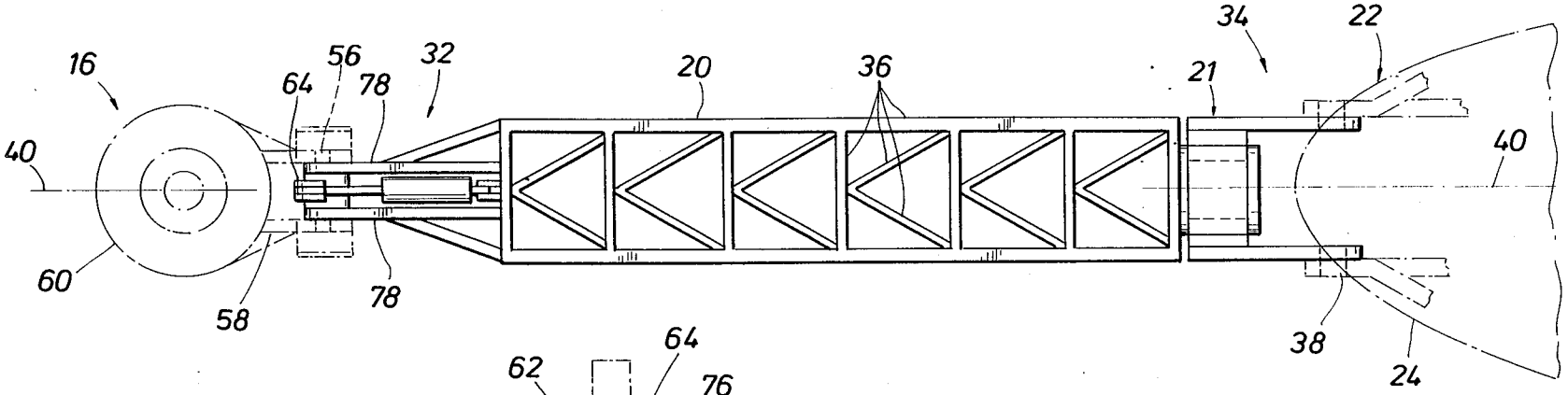
FIG. 2A is a plan view of the articulated mooring arm showing the present invention.
Figure 2B:
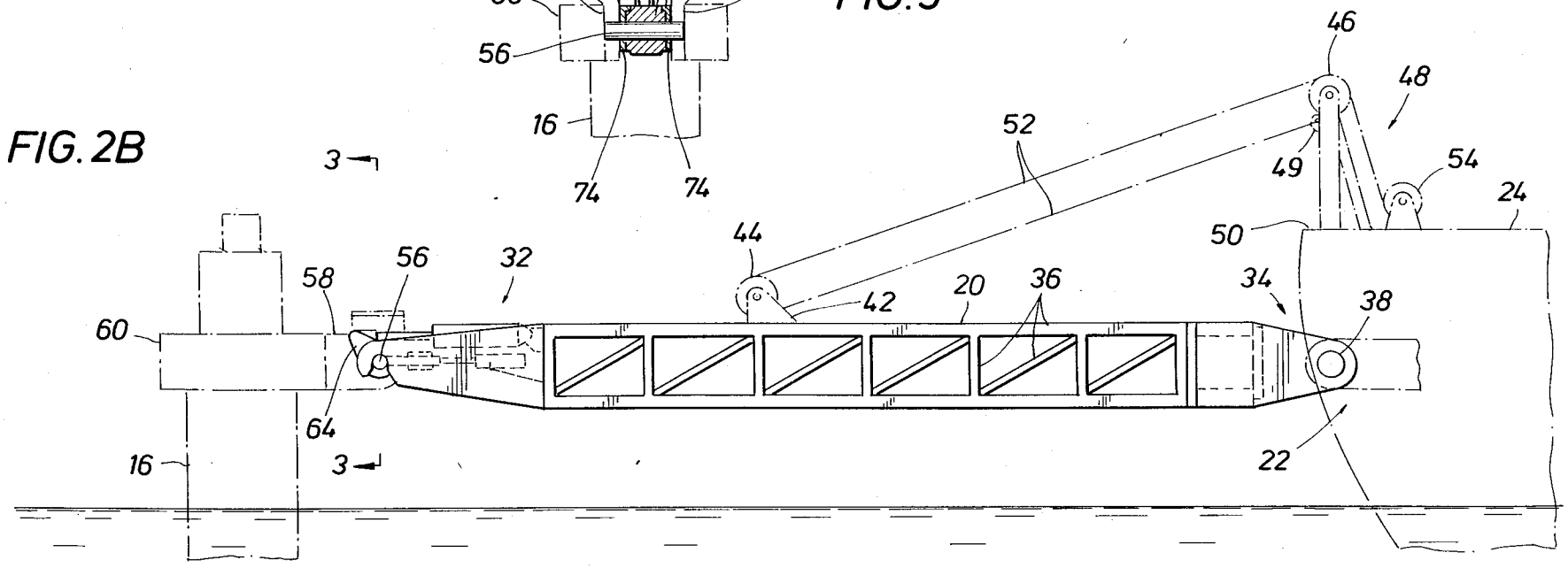
FIG. 2B is an elevation view of the articulated mooring arm showing the present invention.

With reference to FIGS. 2A and 2B, the mooring arm 20 is attached at one end 32 to the riser 16 and at its other end 34 to the bow 22 of the vessel 24. Generally, the articulated mooring arm 20 has a truss framework with interconnecting crossbraces 36 for added rigidity. The mooring arm is usually attached to the bow 22 of the vessel 24 with a pin arrangement 38 which provides a hinge connection permitting the arm 20 to rotate about the pin arrangement 38 in a vertical plane 40. Furthermore, the mooring arm 20 includes a roll shaft 21 to accomodate roll of vessel 10 about its longitudinal axis. Such pin arrangement 38 and roll shaft 21 are well know to those skilled-in-the art.

Attached at approximately mid-span of the articulated mooring arm are gusset plates 42 and a sheave 44. Sheave 44 would be supported between the plates 42 on a pin (not shown). A similar sheave 46 is located at the top of a brace assembly 48 which is attached to the deck 50 at the bow 22. The sheaves 44 and 46 are interconnected by a hoisting line 52 which has one end connected to a bracket 49 on brace assembly 48 and the other end connected to a winch 54. The sheaves 44, 46, hoisting line 52, winch 54, and brace assembly 48 are all part of a hoisting system for rotating the mooring arm 20 about the pin arrangement 38. Thus, it will be obvious based on this disclosure that the hoisting system is used to control and maneuver the mooring arm 20 during the attachment to or disengagement from the riser 16.

Figure 3:
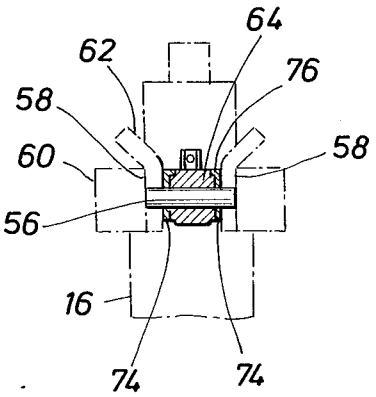
FIG. 3 is a cross-sectional view taken along line 3—3 of FIG. 2B.
Figure 4:
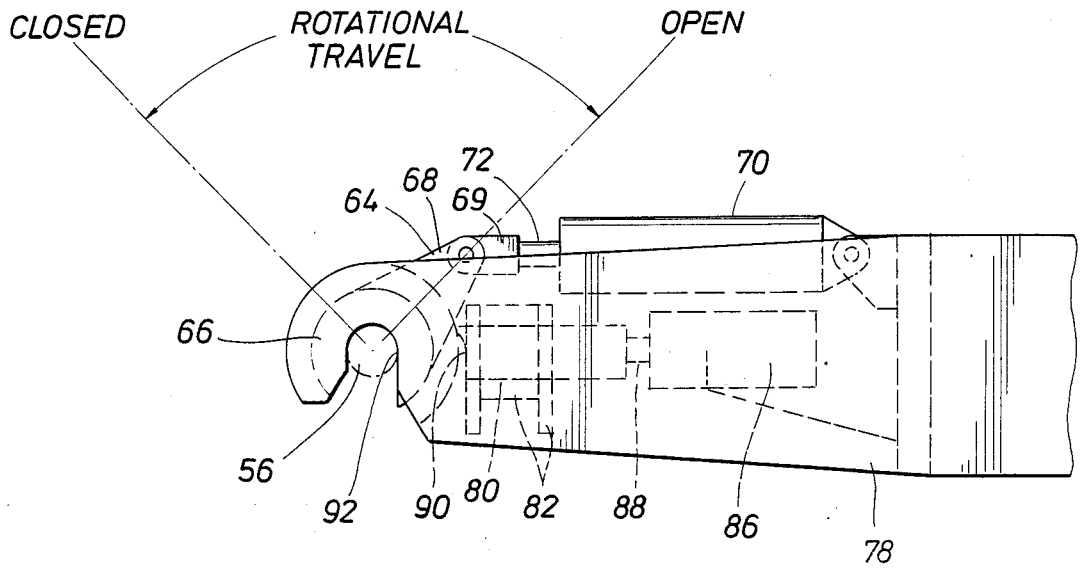
FIG. 4 is a detailed elevation view of the present invention showing the connector in an open position.
Figure 5:
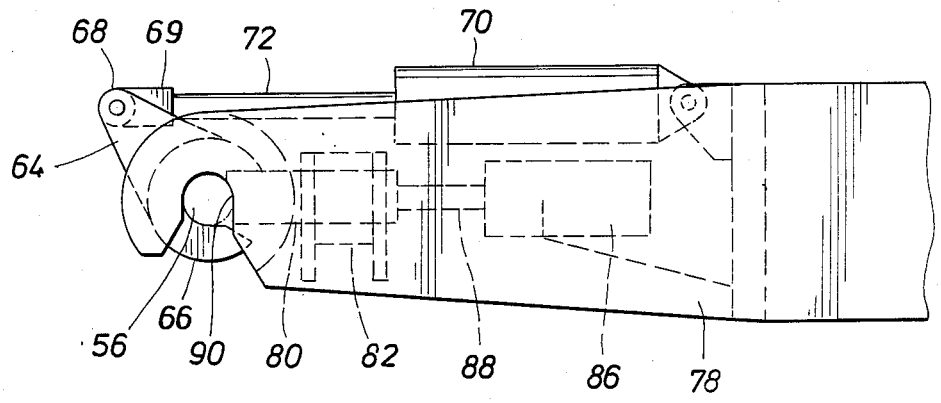
FIG. 5 is a detailed elevation view of the present invention showing the connector in a closed position.

With reference to FIGS. 3, 4 and 5 also, a pin member 56 is located near the top of the riser 16. It is connected to the riser by means of gusset plates 58 which are attached at each end of the pin member 56 and extend back to a mooring swivel 60. Such mooring swivels 60 are well known to those skilled-in-the-art, see for example U.S. Pat. Nos. 4,362,325 and 4,391,298. The gusset plates 58 include a tapered portion 62 for guiding the engaging portion of the present invention onto the pin member 56, as described below. For purposes of the present invention, the gusset plates 58 may be regarded as a first mooring section while the mooring arm 20 may be regarded as a second mooring section.

With particular reference to FIGS. 4 and 5, the present invention includes a latch member 64 having a hook 66 at one end. The hook 66 is adapted to engage the pin member 56. The latch member 64 is connected at its upper end 68 by means of a clevis 69 which is attached to a hydraulic cylinder 70. Activation of the hydraulic cylinder 70 advances a piston rod 72 which rotates the latch member 64 about the pin member 56 once it is engaged. The latch member is restrained laterally by bearings 74 (see FIG. 3). The bearings 74 have a substantially circumferential lip 76 for vertically supporting the latch member. The latch member and the bearings 74 are attached to end 32 of the mooring arm 20 by vertical plates 78.

The present invention also includes a plunger 80 which is supported between the vertical plates 78 by crossbars 82. The plunger is adapted for axial displacement by means of a hydraulic cylinder 86. Once actuated, the hydraulic cylinder 86 advances a piston rod 88 which is attached to the plunger 80. In this manner, the plunger is capable of moving from a first position (as shown in FIG. 4) wherein the end 90 of the plunger is displaced from the interior or open region 92 of the hook 66 to a second position (as shown in FIG. 5) wherein the end 90 of the plunger is located within the open region of the hook.

In the operaion of the present invention, the mooring arm 20 is initially lowered via the hoisting system from a substantially vertical position (not shown) to a substantially horizontal position as generally shown in FIG. 2B. The latch member 64 is maintained in an open position as shown in FIG. 4, during engagement with the pin member 56. Once the hook 66 contacts the pin member 56, hydraulic cylinder 70 is actuated advancing piston rod 72 and thereby displacing the upper end 68 of the latch member. This rotates the latch member in a counterclockwise direction with respect to FIGS. 4 and 5. Once the piston 72 is fully extended and the hook 66 has completely rotated around the pin member, the hydraulic cylinder 86 is actuated advancing the piston rod 88 and thereby the plunger 80 from a first or open position as shown in FIG. 4 to a second or closed (locked) position as shown in FIG. 5. Once the piston 88 is fully extended, the end of the plunger is located within the open region 92 of the hook. This prevents any further rotational movement of the latch member, effectively locking the hook and latch member around the pin member and preventing the release of the mooring arm from the riser or the disconnection of the first mooring section from the second mooring section.

To quickly disengage the mooring arm from the top of the riser, hydraulic cylinder 86 is actuated retracting piston rod 88 and, therefore, the plunger from the closed position of FIG. 5 to the open position of FIG. 4. Hydraulic cylinder 70 is then actuated retracting piston 72 and, therefore, rotating the latch member in a clockwise direction (as shown in FIGS. 4 and 5) to the open position. The hoisting system is then actuated and the mooring arm is raised, thereby completely freeing the mooring arm from the riser.

By selecting the proper sizes of hydraulic cylinders based on the dimensions of the latch member, pin member and plunger, it is possible to initiate the lateral displacement of the plunger and rotation of the latch member within seconds. Such a selection of the proper sizes of hydraulic cylinders is well know to those skilled-in-the-art based on this disclosure. Similarly, it is possible to activate the hoisting system and displace the end of the mooring arm from the top of the riser within moments of the commencement of an emergency condition. The vessel would be made ready beforehand for lateral displacement with respect to the top of the riser to prevent contact between the bow of the vessel and the riser once disconnected. This could be accomplished by tugs or another vessel suitable for movement of the storage vessel to a safe harbor pending the duration of the emergency condition.

The present invention has been describe in terms of various embodiments. Obviously, many modifications and alterations based on the above disclosure will be apparent to those skilled-in-the-art. It is, therefore, intended to cover all such equivalent modifications and variations which fall within the spirit and scope of the claims appended hereto.

What is claimed is:

1. A quick-release connector for securing two offshore mooring sections comprising:

a pin member attached to one end of one mooring section;

a latch member having a hook at one end with an open region therein adapted to engage said pin member and to rotate concentrically about said pin member on a fixed axis substantially corresponding to that of said pin member when in engagement, said latch member being attached to one end of said other mooring section;

a plunger adapted for axial movement between a first position, wherein said plunger is displaced from said open region of said hook, permitting the rotational movement of said latch, and a second position, wherein said plunger advances within said open region of said hook, prohibiting said rotational movement;

means for rotating said latch member about said pin member; and means for longitudinally displacing said plunger between said first and second positions.

2. The quick-ralease connector of claim 1 wherein said plunger is attached to said one end of said other mooring section proximate said latch member.

3. The quick-release connector of claim 1 wherein said means for rotating said latch member comprises a hydraulically-actuated cylinder attached to one end of said latch member opposite said hook.

4. The quick-release connector of claim 1 wherein said means for displacing said plunger comprises a hydraulically-actuated cylinder attached to one end of said plunger.

5. A quick-release mooring apparatus for a vessel floating in a body of water comprising:

a base attached to the floor of said body of water;

a riser attached at one end to said base and extending above the surface of said body of water in a substantially vertical position;

a first mooring section attached at one end to the top of said riser and having a pin member at the other end;

a second mooring section attached at one end to said vessel and having a latch member at the other end, said latch member having a hook with an open region therein adapted to engage said pin member and to rotate concentrically about said pin member on a fixed axis substantially corresponding to that of said pin member when in engagement;

a plunger adapted for longitudinal movement between a first position wherein said plunger is displaced from said open region of said hook, permitting the rotational movement of said latch member, and a second position, wherein said plunger advances within said open region of said hook, prohibiting said rotational movement;

means for rotating said latch member about said pin member; and means for axially displacing said plunger between said first and second positions.

6. The quick-release mooring apparatus of claim 5 wherein said apparatus further comprises means for rotating said second mooring section in a substantially vertical plane about said one end of said second mooring section.

7. The quick-release mooring apparatus of claim 5 wherein said means for rotating said latch member comprises a hydraulically-actuated cylinder attached to one end of said latch member opposite said hook.

8. The quick-release mooring apparatus of claim 5 wherein said plunger is attached to said other end of said second mooring section proximate said latch member.

9. The quick-release mooring apparatus of claim 5 wherein said means for displacing said plunger comprises a hydraulically-actuated cylinder attached to one end of said plunger.

10. A quick-release connector for securing two offshore mooring sections comprising:

a pin member attached to one end of one mooring section;

a latch member having a hook at one end with an open region therein adapted to receive said pin member;

a bearing mounted on one end of said other mooring section, said bearing being substantially coaxial with said open region of said hook;

a fixed member mounted on said one end of said other mooring section, said fixed member having an open region adapted to receive said pin member; and means for rotating said latch member concentrically about said pin member on said bearing, whereby said open region of said latch member is rotated relative to said open region of said fixed member to substantially surround the circumference of said pin member.

11. The quick-release connector of claim 10 further comprising:

a plunger adapted for axial movement between a first position, wherein said plunger is displaced from said latch member, permitting the rotational movement of said latch member, and a second position, wherein said plunger advances within said open region of said hook, prohibiting said rotational movement of said latch member; and means for moving said plunger between said first and second positions.

12. The quick-release connector of claim 11 wherein said means for rotating said latch member comprises a hydraulically-actuated cylinder attached to one end of said latch member opposite said hook.

13. The quick-release connector of claim 11 wherein said plunger is attached to said one end of said other mooring section proximate said latch member.

14. The quick-release connector of claim 11 wherein said means for displacing said plunger comprises a hydraulically-actuated cylinder attached to one end of said plunger.

* * * * *